US007140319B2

(12) United States Patent
Raines

(10) Patent No.: US 7,140,319 B2
(45) Date of Patent: Nov. 28, 2006

(54) PILE ANCHOR WITH EXTERNAL VANES

(75) Inventor: Richard D. Raines, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/541,290

(22) PCT Filed: Feb. 17, 2004

(86) PCT No.: PCT/US2004/004742

§ 371 (c)(1),
(2), (4) Date: Jun. 30, 2005

(87) PCT Pub. No.: WO2004/079100

PCT Pub. Date: Sep. 16, 2004

(65) Prior Publication Data

US 2006/0065180 A1 Mar. 30, 2006

Related U.S. Application Data

(60) Provisional application No. 60/451,734, filed on Mar. 4, 2003.

(51) Int. Cl.
*B63B 21/27* (2006.01)

(52) U.S. Cl. ..... 114/296; 405/224

(58) Field of Classification Search ..... 114/295, 114/296; 405/204, 224, 226, 227, 228
See application file for complete search history.

(56) References Cited

U.S. PATENT DOCUMENTS

| | | | | |
|---|---|---|---|---|
| 3,036,542 | A * | 5/1962 | Robinson | 114/295 |
| 3,411,473 | A * | 11/1968 | Mott et al. | 114/296 |
| 3,496,900 | A | 2/1970 | Mott et al. | 114/206 |
| 3,621,805 | A * | 11/1971 | Smith | 114/305 |
| 3,805,534 | A * | 4/1974 | Brasted | 405/228 |
| 3,817,040 | A | 6/1974 | Stevens | 61/53.5 |
| 3,969,853 | A | 7/1976 | Deike | 52/156 |
| 4,257,721 | A * | 3/1981 | Haynes | 405/227 |
| 4,318,641 | A | 3/1982 | Hogervorst | 405/224 |
| 4,432,671 | A * | 2/1984 | Westra et al. | 405/226 |
| 4,575,282 | A | 3/1986 | Pardue, Sr. et al. | 405/228 |
| 4,619,218 | A | 10/1986 | Kenny | 114/295 |
| 5,033,908 | A | 7/1991 | Auraen | 405/204 |
| 5,704,732 | A | 1/1998 | Horton, III | 405/228 |
| 5,915,326 | A | 6/1999 | Karal | 114/294 |
| 6,309,269 | B1 | 10/2001 | Fulton et al. | 441/1 |
| 6,457,908 | B1 | 10/2002 | Bergeron | 405/224 |
| 6,461,084 | B1 | 10/2002 | Stuart | 405/244 |

(Continued)

FOREIGN PATENT DOCUMENTS

GB 1 269 599 4/1972

(Continued)

OTHER PUBLICATIONS

European Search Report RS 110207 for U.S. Appl. No. 60/451,734, mailed Oct. 13, 2003, 3 pages.

(Continued)

*Primary Examiner*—Lars A. Olson
(74) *Attorney, Agent, or Firm*—ExxonMobil Upstream Research Company Law Dept.

(57) ABSTRACT

An elongated hollow member (160), as shown in FIG. 1, with longitudinally disposed external vane(s) (275A–B) for securing an offshore structure to the seafloor. The external vanes help maintain the heading and bearing of the anchor during the installation process, and may also enhance the pile anchor's holding capacity.

29 Claims, 6 Drawing Sheets

U.S. PATENT DOCUMENTS

| | | | | |
|---|---|---|---|---|
| 6,685,396 | B1 * | 2/2004 | Bergeron | 405/224 |
| 6,719,496 | B1 | 4/2004 | Von Eberstein | 405/224 |

FOREIGN PATENT DOCUMENTS

| | | |
|---|---|---|
| GB | 2 368 329 | 5/2002 |
| JP | 58149886 | 9/1983 |
| WO | WO 2004/078576 A2 | 9/2004 |
| WO | WO 2004/078576 A3 | 9/2004 |

OTHER PUBLICATIONS

International Search Report and Written Opinion for PCT/US04/04742, mailed Nov. 8, 2004, 8 pages.
International Preliminary Report on Patentability for PCT/US04/04742, mailed Apr. 22, 2005, 4 pages.

* cited by examiner

PILE ANCHOR WITH EXTERNAL VANES

CROSS REFERENCE TO RELATED APPLICATIONS

This application is the National Stage of International Application No. PCT/US04/04742, filed 17 Feb., 2004, which claims the benefit of U.S. Provisional Application 60/451,734, filed 4 Mar., 2003.

FIELD OF THE INVENTION

This invention relates generally to pile anchor technology, and in particular, to a novel pile anchor having external vanes. The external vanes help maintain the heading and bearing of the anchor during installation, and may also enhance the holding capacity of the anchor.

BACKGROUND OF THE INVENTION

Offshore structures, such as those used by the petroleum industry, are sometimes moored to the seafloor using pile anchors. Existing pile anchors may generally be described as a single tubular element, typically circular in cross section, with a closed top and an open bottom. The ability of a pile anchor to moor an object is typically referred to as an anchor's "holding capacity." In general, the holding capacity of a pile anchor increases with the size of the anchor. However, typically as the size of the anchor increases, so does the anchor's material, fabrication and installation costs. Additional background can be found in U.S. Pat. No. 5,915,326 to Karal, G B U.S. Pat. No. 1,269,599 A to Joppa et al., U.S. Pat. No. 5,704,732 to Horton, and U.S. Pat. No. 4,619,218 to Kenny. What is needed is a pile anchor installation system that reduces the high costs of material, fabrication and installation without substantially reducing the anchor's holding capacity.

There is also a need in the industry for a pile anchor that can maintain its holding capacity at a reduced size, or alternatively, that has an increased holding capacity for a given size. By increasing a pile anchor's holding capacity, one may be able to reduce the total number of pile anchors required to moor a floating structure. Decreasing the number of pile anchors reduces the material costs and installation time, which can be a significant cost component of offshore construction. The present invention may satisfy these needs.

SUMMARY OF THE INVENTION

This invention includes a pile anchor for use in mooring an offshore structure to the seafloor. The anchor includes an elongated hollow member having an upper end, an open lower end and a longitudinal axis, a load transfer device or means for connecting an anchor line to the elongated hollow member, a first longitudinally disposed vane extending outwardly from the outer surface of the elongated hollow member. The elongated hollow member may be a circular tubular member. The upper end of the elongated hollow member alternatively has the capacity to regulate fluid flow. The load transfer device is fixed to the outer surface of the elongated hollow member. The elongated hollow member alternatively has a second longitudinally disposed vane extending outwardly from the outer surface of the elongated hollow member.

The invention also includes a method of anchoring a pile anchor into the floor of a body of water. The method includes installing a pile anchor into the floor of the body of water.

The pile anchor includes (i) an elongated hollow member having an upper end, an open lower end, a longitudinal axis and a transverse cross section, (ii) a load transfer device for connecting an anchor line to the elongated hollow member, the load transfer device fixed to the outer surface of the elongated hollow member and positioned on the circumference of the elongated hollow member, and (iii) a first longitudinally disposed vane extending outwardly from the outer surface of the elongated hollow member.

Another embodiment of the invention provides a method of producing offshore hydrocarbon resources. The method includes anchoring an offshore structure to the seabed through use of a pile anchor. The pile anchor includes (i) an elongated hollow member having an upper end, an open lower end, a longitudinal axis and a transverse cross section; (ii) a load transfer device for connecting an anchor line to the elongated hollow member, the load transfer device fixed to the outer surface of the elongated hollow member and positioned on the circumference of the elongated hollow member; and (iii) a first longitudinally disposed vane extending outwardly from the outer surface of the elongated hollow member. The method further includes connecting the load transfer device to an offshore structure and producing hydrocarbon resources.

DETAILED DESCRIPTION OF THE INVENTION

As used herein and in the appended claims the phrase "elongated hollow member" is meant to refer to any device that forms an enclosure on all its sides except that its top and bottom ends may be open or closed with a cap. For example, by way of illustration and not limitation, a circular, rectangular or elliptical conduit with a closed or open top and lower end. An elongated hollow member may be completely hollow within its interior or may be only partially hollow, for example including internal structural bracing within the elongated hollow member. The elongated hollow members according to the invention may have an open lower end.

In general, pile anchors are installed by being lowered into the soil in a controlled descent, with the weight of the anchor being the initial driving force. Cables are used to help control the descent of the pile anchor, and pressure release mechanisms, such as two-way flow valves on the pile anchor, are opened to allow water to evacuate from interior of the pile anchor, thereby allowing penetration of the pile anchor into the soil. This process is referred to as self-weight penetration. Usually self-weight penetration is followed by applying another force on the anchor to obtain the final penetration depth. Typically, this force is applied by way of suction penetration. In suction penetration, a water evacuation pump is attached to the suction pile anchor and water is pumped out from the anchor's interior. The differential water pressure that is created results in a net downward force that is used to push the suction pile anchor to final penetration. A direct force can also be applied on the anchor, such as using a pile-driving hammer, to achieve final penetration. The direct force can be used either alone or in combination with suction penetration.

The anchoring device of this invention has the general configuration of an elongated hollow member, but in addition has one or more longitudinally disposed vanes located on the exterior of the anchor. In one alternative embodiment the anchor has two vanes located on either side of the load transfer connection point. The vanes can be constructed of the same materials as the suction pile anchor, or other structural materials as would be evident to one of ordinary skill in the art. A pile anchor may be any elongated hollow member, including a circular cylindrical member. It can be fabricated in other geometries, however, such as an elliptical cylinder, rectangular conduit, etc. and can have various length to diameter ratios.

Figure 1:
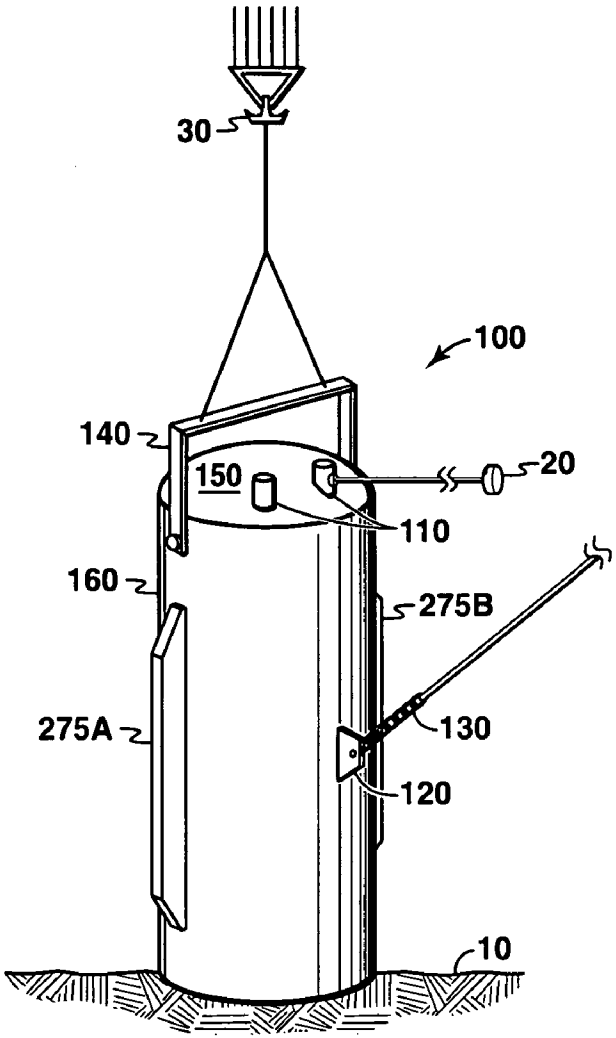
FIG. 1 illustrates one embodiment of a pile anchor according to the invention.

An example of one embodiment of a pile anchor is provided in FIG. 1, which shows the pile anchor (100) as made up of a cylindrical body (160) that is closed at the top by a cap (150), and open at its lower end. A load transfer connection point, such as a padeye (120), is located on the side of pile anchor (100) to attach an anchor chain (130) which transfers the load from an offshore structure (not shown), such as a floating structure, DDCV, drilling or production riser, pipeline, semi-submersible, drilling vessel, subsea structure, or other structure. The anchor (100) includes at least one vane (275A) attached to the main body of the anchor and alternatively a second vane (275B). Cap (150) alternatively contains two-way flow valve(s) (110). Water evacuation pump (20) can be connected to a flow valve (110) to regulate fluid flow between the interior and exterior of the anchor to provide for suction installation. During the installation process, the pile anchor (100) is supported by deployment hardware such as spreader bar (140), which in turn can be supported by a crane (or other surface machinery) through crane hook (30). Pile anchor (100) may be embedded in the sea floor (10) through the installation methods previously described and those hereafter described.

Figure 2:
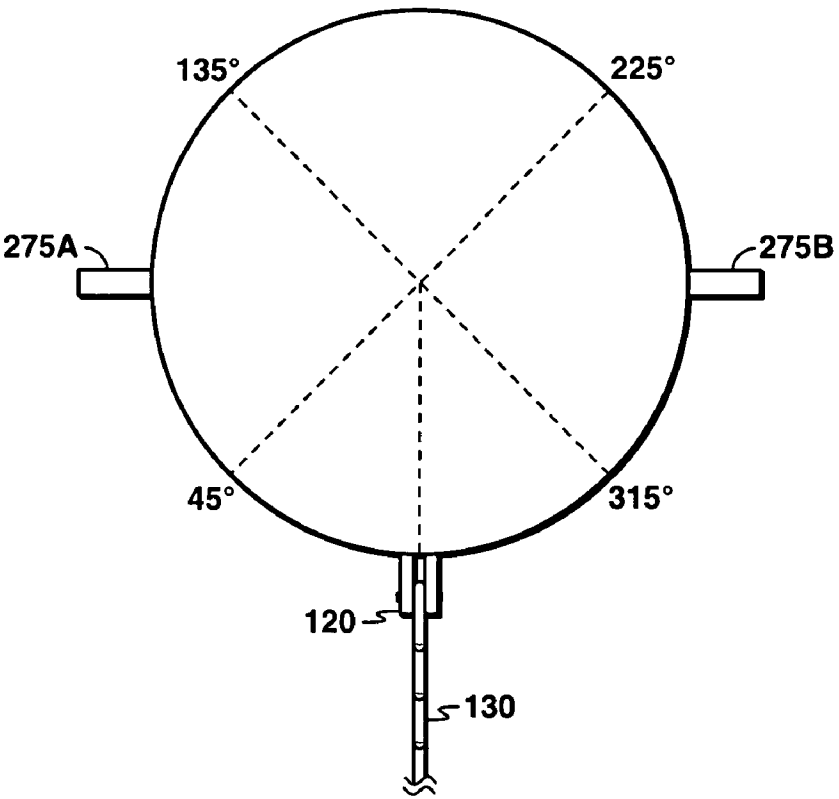
FIG. 2 is a top view of one embodiment of an anchor in accordance with this invention, which illustrates a padeye as the 0 degree reference point.

Referring now to FIG. 2, for the purposes of describing this embodiment of the invention, the load transfer connection point, or padeye (120), will be considered as the 0 degree reference point. Measurement of the deviation from this reference point is made in a clockwise direction. Referring again to FIG. 2, in accordance with one embodiment of this invention, at least one longitudinally disposed vane (275A) is alternatively located between about 45 degrees and about 135 degrees from padeye (120), and optionally a second longitudinally disposed vane (275B) is alternatively located between about 225 degrees and about 315 degrees from padeye (120). However, the anchors according to the invention may be constructed such that the vanes depicted in FIG. 2 are attached to the elongated hollow member (160) at angles greater or less than those specified in this paragraph, for example at about 35 to 145 and about 215 to 325 degrees, at about 25 to 155 and about 205 to 335 degrees or about 55 to 125 and about 235 to 305 degrees.

The length of the vanes (275A & 275B) that protrude from the elongated hollow member can vary in both the longitudinal and radial directions. Generally these lengths can be optimized by designing vane lengths with reference to the soil conditions at the intended installation site using engineering judgment. In this paragraph the referenced dimensions apply to the portion of the vane that is protruding from and exterior to the elongated hollow element. In one embodiment the vanes may be between about 2 to 200 percent of the average diameter of the elongated hollow member (160) in the radial direction. The vanes may alternatively be between about 5 to 90, 10 to 70, 15 to 60, or 20 to 55 percent of the average diameter of the elongated hollow member in the radial direction. The vanes may also be constructed to a certain length in the longitudinal direction. In one embodiment the vanes are from 5 to 150 percent of the average length of the elongated hollow member in the longitudinal direction. The vanes may alternately be from 10 to 100, 25 to 100, 50 to 100, 45 to 100, or 45 to 95 percent of the average length of the elongated hollow member in the longitudinal direction.

Figure 3:
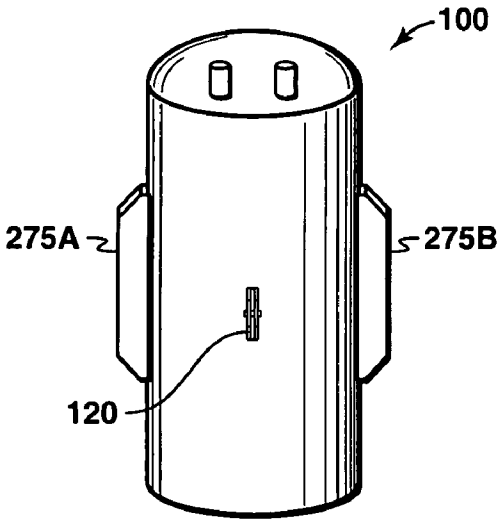
FIG. 3 is a schematic view of one embodiment of an anchor made in accordance with this invention.

Referring now to FIG. 3, an embodiment of the current invention is shown with vanes (275A) and (275B) located on the anchor (100) on either side of padeye (120) in accordance with one embodiment of this invention.

Figure 4:
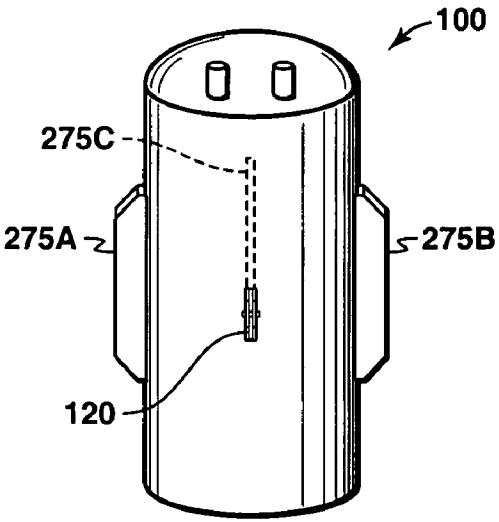
FIG. 4 is a schematic view of one embodiment of an anchor made in accordance with this invention with an additional longitudinally disposed vane attached to the back of the anchor

Additional longitudinally disposed vanes can extend from the anchor (100). The additional vane or vanes can be located on the back and/or the front of the anchor. The "front quarter" of the anchor includes the portion of the anchor extending from about 315 degrees to about the 0 degree reference point and from about the 0 degree reference point to about 45 degrees, or in other words from about 45 degrees on each side of the padeye (120). The "back quarter" of the anchor is that section of the anchor that lies between about 135 degrees to about 225 degrees from padeye (120). Referring to FIG. 4, a preferred embodiment of the invention is shown containing an additional longitudinally disposed vane (275C) attached to the back quarter of the anchor.

Figure 5:
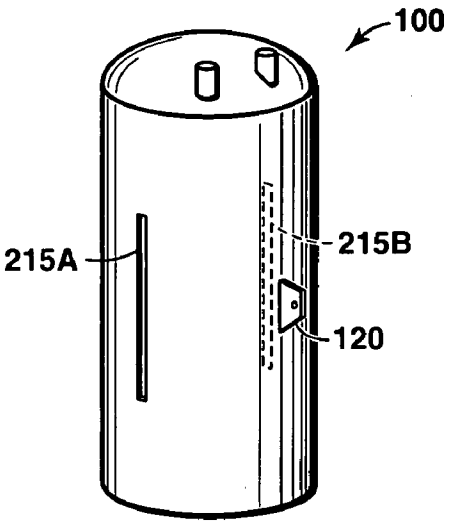
FIG. 5 is a schematic view of one embodiment of this invention wherein slots are used to secure the longitudinally disposed vanes to the tubular member.

Connection of the vanes to the anchor (100) can be accomplished by commonly known methods. For example, the vane may be attached to the anchor's exterior by known welding techniques. In another preferred embodiment shown in FIG. 5, slots (215) are provided in anchor (100), and the vanes are attached to anchor (100) by inserting them through the slots (215) and then attaching the vanes to the slots using common techniques, such as welding. When connecting the vanes to the anchor (100) through slots, a relatively tight seal is needed between the vane and slot to prevent water from flowing into the anchor during suction installation. Diametrically aligned vanes, for example vanes (275A) and (275B) shown in FIG. 4, may be fabricated in one piece and assembled to fit through both slots (215A) and (215B) in the suction pile anchor (100). In this configuration, the vanes in combination with other associated internal bracing (not shown) could also provide structural support for the padeye (120).

The vanes (275A) and (275B) are depicted in this one embodiment as straight planar elements coming off of the main body (160) of the anchor (100) perpendicular to a plane tangent to the anchor's main body (160) and parallel to the longitudinal axis of the main anchor body (160); however, the vanes according to the invention are not limited to straight planar vanes, to vanes which are attached perpendicular to a plane tangent to the outer surface of the anchor's main body, nor to vanes parallel to the longitudinal axis of the main body of the anchor. The vanes according to the invention may be of many varied shapes including, but not limited to, curved vanes or vanes made up of multiple planar elements attached at various angles in a hinged manner. The various vane shapes may be attached in a substantially longitudinal manner with respect to the main body of the anchor or be attached at an angle with respect to the longitudinal axis of the main anchor body. The vanes may also be attached at an angle other than ninety degrees (i.e. perpendicular) from a plane that is tangent to the outer surface of the main body of the anchor.

Figure 6:
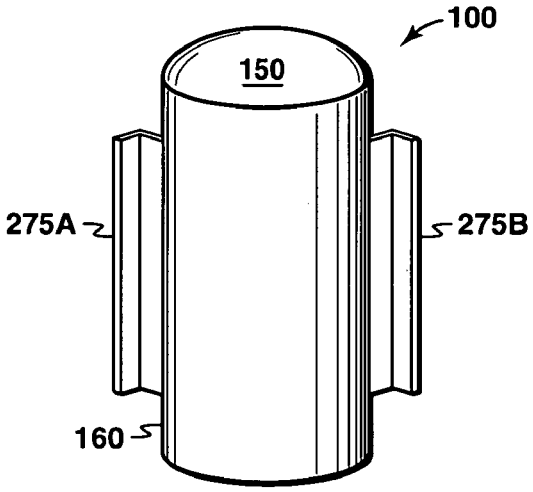
FIG. 6 is a schematic view of one embodiment of the invention that has two-part planar vanes.
Figure 7:
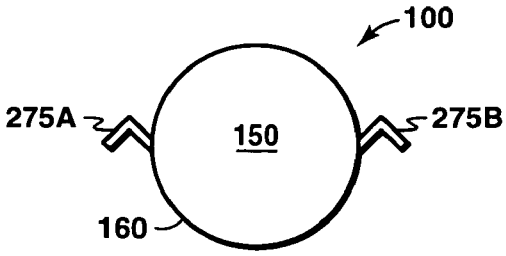
FIG. 7 is an overhead view of one embodiment of the invention that has two-part planar vanes.

FIG. 6 depicts an anchor (100) with two vanes (275A & 275B) that are attached to the elongated hollow member (160) at an angle relative to a plane tangent to the circular elongated hollow member (160). The vanes (275A & 275B) are also not a single planar shape, but are located in two separate planes that form an angle at the point of attachment. FIG. 7 depicts an overhead view of the anchor (100) depicted in FIG. 6 which further displays the angled attachment of the vanes (275A & 275B) and the biplanar form of the vanes (275A & 275B).

Figure 8:
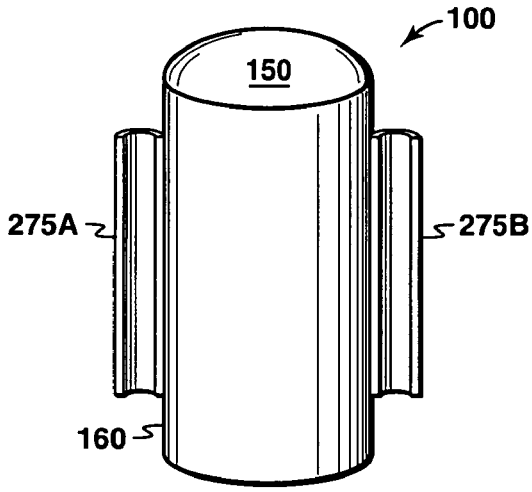
FIG. 8 is a schematic view of one embodiment of the invention that has curved non-planar vanes.
Figure 9:
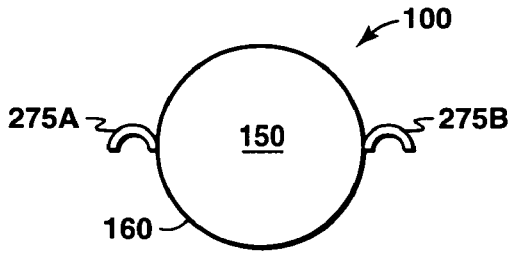
FIG. 9 is an overhead view of one embodiment of the invention that has curved non-planar vanes.

FIG. 8 depicts an anchor (100) with two curved, semi-circular, non-planar vanes (275A & 275B). FIG. 9 displays an overhead view of the anchor (100) and vanes (275A & 275B) depicted in FIG. 8.

Figure 10:
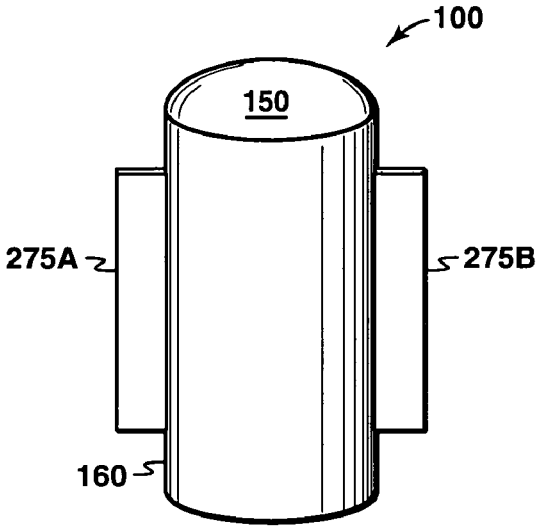
FIG. 10 is a front-side schematic view of one embodiment of the invention that has two-part planar vanes.
Figure 11:
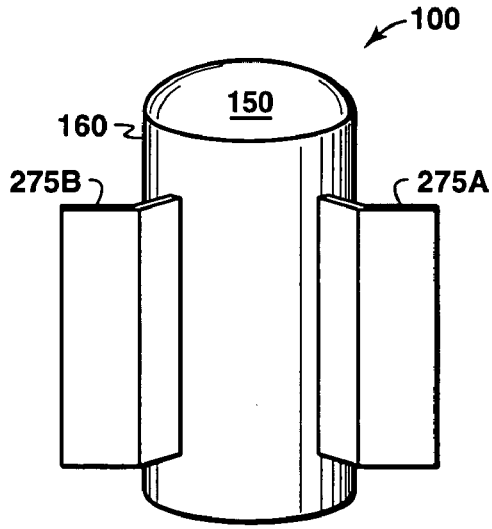
FIG. 11 is a back-side schematic view of one embodiment of the invention that has two-part planar vanes.
Figure 12:
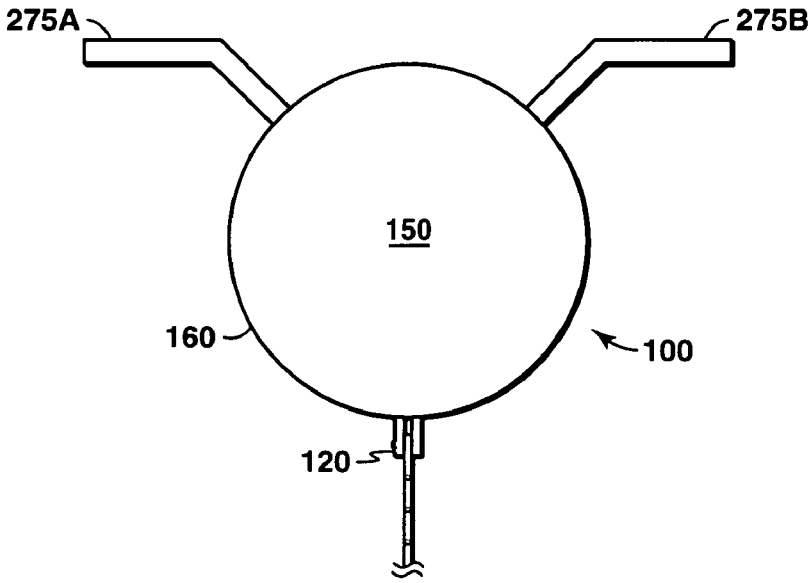
FIG. 12 is an overhead view of one embodiment of the invention that has two-part planar vanes.

FIG. 10 depicts an anchor (100) with two vanes (275A & 275B) that, while attached perpendicular to the plane tangent to the circular elongated hollow member (160), contain two planar vane elements which are attached at an angle. The vanes are attached to the back side of the anchor (100) at about 135 degrees and 225 degrees respectively from the padeye (120). FIGS. 11 and 12 display the reverse angle and above view of the anchor (100) depicted in FIG. 10. However, the anchors according to the invention may be constructed such that the vanes depicted in FIGS. 10, 11, and 12 are attached to the elongated hollow member (160) at angles greater or less than those specified in this paragraph, for example at about 125 and 235 degrees respectively from the padeye (120) or about 145 and 215 degrees respectively from the padeye (120).

Figure 13:
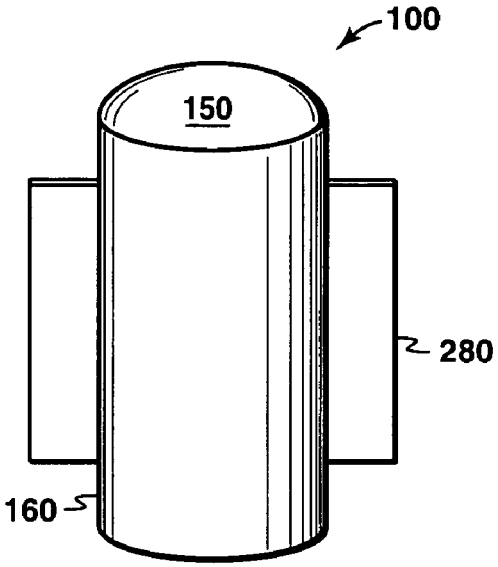
FIG. 13 is a front-side schematic view of one embodiment of the invention that has a single planar vane.
Figure 14:
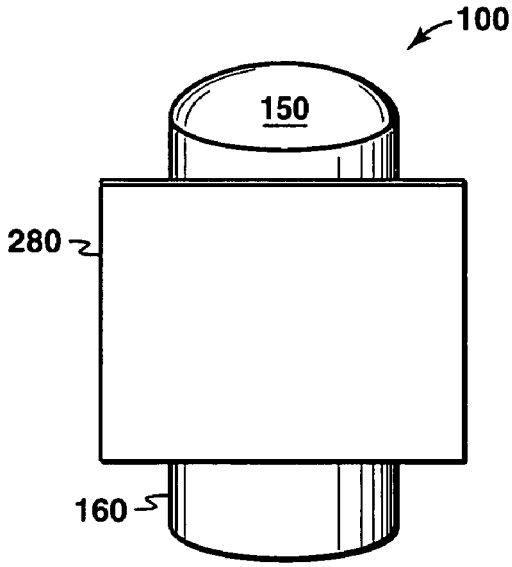
FIG. 14 is a back-side schematic view of one embodiment of the invention that has a single planar vane.
Figure 15:
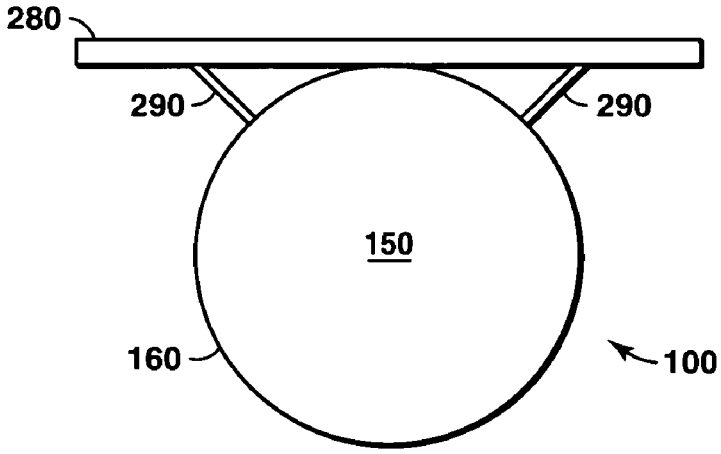
FIG. 15 is an overhead view of one embodiment of the invention that has a single planar vane.

FIG. 13 depicts the front-side view of an anchor (100) that has a single planar vane (280) attached to the back-side of the anchor's main body (160) such that opposing ends of the vane act like separate vanes as in the embodiment disclosed in FIGS. 1, 2 and 3. FIG. 14 presents the backside view, while FIG. 15 presents an overhead view of the same single vane arrangement. The single vane of this configuration may require additional external bracing (290) as depicted in FIG. 15.

In the various embodiments described herein, longitudinally disposed vanes (275A) and (275B) will also increase the soil bearing area of the anchor (100) against lateral displacement and will therefore increase the anchor's holding capacity. Accordingly, with vanes (275A) and (275B), an anchor (100) may be designed smaller in size while maintaining a given holding capacity, thereby obtaining cost benefits for material and installation.

The dimensions, configuration and number of the vanes incorporated on anchor (100) can be determined by one of ordinary skill in the art based upon factors including the application, the soil engineering properties, the bearing and heading of the anchor, the magnitude and types of loading conditions, and the economies of fabrication and installation operations.

The vanes aid in the installation of the anchor (100) by maintaining the bearing and heading of the anchor during self-weight penetration and suction installation, or during installation by other methods. This ability to maintain an anchor's bearing and heading is particularly useful for the installation method described in co-pending U.S. patent application Ser. No. 10/382,291, filed Mar. 5, 2003, titled Method for Installing a Pile Anchor, the entirety of which is hereby incorporated by reference herein. The referenced co-pending application discloses an installation method that enhances the holding capacity of a pile anchor by installing the pile anchor at an angle with respect to the seafloor so that the top of the anchor is inclined in a direction opposite to the applied load. The anchor is positioned at an inclined angle with respect to the sea floor, with the top of the anchor inclined in a direction away from the direction of lateral loading, and then inserted at least partially into the seafloor while the angle of inclination is substantially maintained. The present invention therefore also includes a method for installing a pile anchor into the sea floor, and in particular, the invention permits reducing or eliminating the vertical load acting upon a pile anchor and correspondingly increasing the lateral load component, thereby enhancing the anchor's holding capacity. An elongated hollow element, such as the pile anchor (100), embedded in a typical sea floor (10) stratigraphy can achieve a higher holding capacity when it is displaced through the soil perpendicular to its longitudinal axis, as opposed to displacement along its longitudinal axis. These load components represent lateral soil resistance (bearing resistance) and vertical soil resistance (sliding frictional resistance), respectively. The preferred method for deploying the tubular member described herein will permit the pile anchor 100 to be installed so the vertical load component can be reduced incrementally, or completely eliminated.

As further described in co-pending U.S. patent application Ser. No. 10/382,291, filed Mar. 5, 2003, titled Method for Installing a Pile Anchor, a preferred embodiment of the invention where the anchor is installed at an angle the suction pile anchor 100 may be installed using a guide frame to create and maintain the desired angle of inclination. In another preferred embodiment of the invention, the desired angle of inclination is created and maintained by connecting a tensioning device to provide upward tension to the side of the pile anchor (100) on which the lateral load connection is applied, i.e., padeye (120). For example, anchor chain (130) may serve as the tensioning device for this embodiment. Alternative tensioning devices can be used, which include but are not limited to a lifting cable, or bar (or other rigid member). Another embodiment of this invention provides a pile anchor (100) with internal compartments that can be selectively evacuated of water to provide selective buoyancy for the pile anchor (100). By selectively adjusting the buoyancy of the pile anchor (100), the desired angle of inclination can be achieved during installation. In another preferred embodiment the spreader bar (140) or other deployment hardware is attached to the pile anchor (100) at an offset position so that the axis of rotation is not through the center of gravity of the pile (100). The spreader bar (140) or other deployment hardware is positioned such that the suction pile anchor (100) naturally assumes the desired angle of inclination when it is deployed. Rigging cables or slings may be employed in these embodiments to steady the suction pile anchor (100) during lowering and initial insertion into the sea floor (10).

The installation method disclosed above and in U.S. patent application Ser. No. 10/382,291, filed Mar. 5, 2002, titled Method for Installing a Pile Anchor, enhances the anchor's holding capacity. Accordingly, installation of the novel anchoring system (100) in conjunction with the method disclosed in the referenced co-pending Patent Application may provide an anchor that can maintain the same holding capacity at a reduced size.

Figure 16:
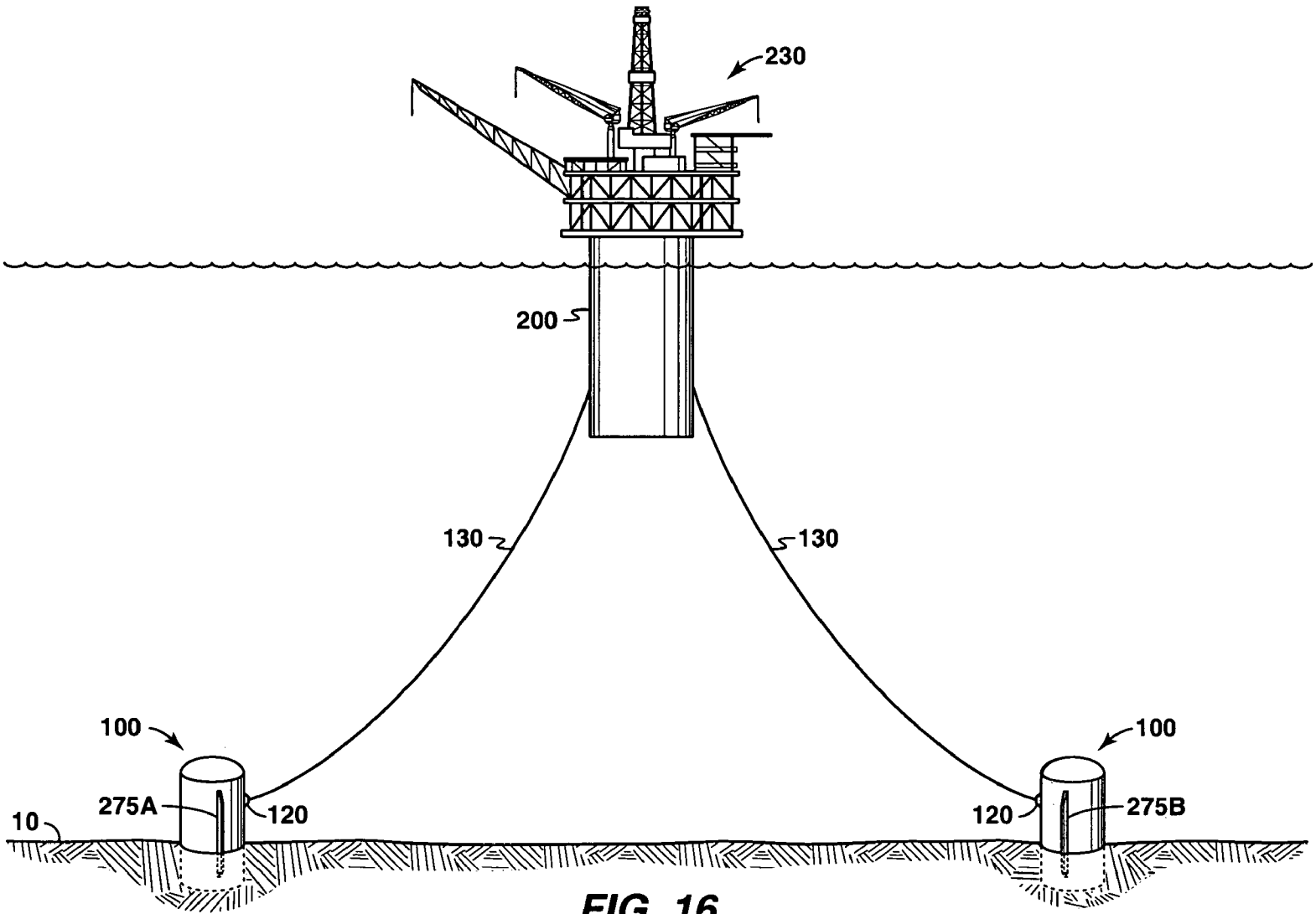
FIG. 16 illustrates an offshore spar that is anchored using the anchors of the invention.

FIG. 16 depicts an embodiment of the invention where pile anchors (100) are used to anchor an offshore structure (200) through use of anchor chains (130) connected to such pile anchors (100) through use of a load transfer device (120). The offshore structure (200) may be for example a spar (e.g. a deep draft caisson vessel ("DDCV") or a truss spar) that is equipped with a deck (230). The deck (230) can support offshore hydrocarbon resource (i.e. oil and gas) exploration, drilling and production operations. The deck may be use to conduct offshore seismic data collection. Alternatively, the deck can support offshore drilling equipment for oil and/or gas drilling operations. The deck may also support oil and/or gas production equipment for the production of oil and gas natural resources. Produced oil and/or gas may then be offloaded from the deck by, for example, pipeline to shore or a transport ship or barge and then moved to shore. The oil and gas may then be refined into usable petroleum products such as, for example, natural gas, liquefied petroleum gas, gasoline, jet fuel, diesel fuel, heating oil or other petroleum products.

The present invention has been described in connection with its preferred embodiments. However, to the extent that the foregoing description is specific to a particular embodiment or a particular use of the invention, this is intended to be illustrative only and is not to be construed as limiting the scope of the invention. On the contrary, it is intended to cover all alternatives, modifications, and equivalents that are included within the spirit and scope of the invention, as defined by the appended claims.

I claim:

1. A pile anchor, comprising:

a. an elongated hollow member having an upper end, an open lower end and a longitudinal axis;

b. a two-way flow valve located on said elongated hollow member;

c. a load transfer device for connecting an anchor line to said elongated hollow member, said load transfer device fixed to the outer surface of said elongated hollow member and positioned on the circumference of said elongated hollow member;

d. a first longitudinally disposed vane extending outwardly from the outer surface of said elongated hollow member; and e. a second longitudinally disposed vane extending outwardly from said outer surface of said elongated hollow member; wherein said first longitudinally disposed vane is attached through a first slot in said elongated hollow member and said second longitudinally disposed vane is attached through a second slot in said elongated hollow member.

2. The pile anchor of claim 1, further comprising a plurality of two-way flow valves located on said elongated hollow member.

3. The pile anchor of claim 2, wherein said first longitudinally disposed vane and said second longitudinally disposed vane have a longitudinal length that is about 50 to 100 percent of the average longitudinal length of the elongated hollow member.

4. The pile anchor of claim 3, wherein said first longitudinally disposed vane and said second longitudinally disposed vane have a radial length that is about 5 to 90 percent of the average diameter of the elongated hollow member.

5. The pile anchor of claim 4, wherein said elongated hollow member is substantially tubular in shape and has a substantially circular cross sectional area.

6. The pile anchor of claim 5, wherein said upper end of said elongated hollow member is closed and wherein said valves are located on the upper end of said elongated hollow member, said valves adapted for regulating fluid flow across said upper end of said elongated hollow member.

7. The pile anchor of claim 6, wherein said load transfer device is positioned at the zero degree location on the circumference of said elongated hollow member, said first longitudinally disposed vane is positioned between about 25 degrees and about 155 degrees from said zero degree location, and said second longitudinally disposed vane is positioned between about 205 degrees and about 335 degrees from said zero degree location.

8. The pile anchor of claim 7, wherein said first longitudinally disposed vane is positioned between about 45 degrees and about 135 degrees from said zero degree location, and said second longitudinally disposed vane is positioned between about 225 degrees and about 315 degrees from said zero degree location.

9. The pile anchor of claim 8, further comprising at least one additional longitudinally disposed vane extending outwardly from the outer surface of said elongated hollow member positioned between about 135 degrees and about 225 degrees from said zero degree location.

10. The pile anchor of claim 9, further comprising at least one additional longitudinally disposed vane extending outwardly from the outer surface of said elongated hollow member positioned between about 45 degrees on each side of said zero degree location on the outer surface of said tubular member.

11. The pile anchor of claim 7, wherein said load transfer device comprises a padeye.

12. The pile anchor of claim 8, wherein said first and second slots are diametrically opposed, and said first and second longitudinally disposed vanes comprise a single vane extending through said first and second slots in said elongated hollow member.

13. A method of anchoring a pile anchor into the floor of a body of water, comprising:

installing a pile anchor into the floor of said body of water, said pile anchor including (i) an elongated hollow member having an upper end, an open lower end, a longitudinal axis and a transverse cross section, (ii) a two-way flow valve located on said elongated hollow member, (iii) a load transfer device for connecting an anchor line to said elongated hollow member, said load transfer device fixed to the outer surface of said elongated hollow member and positioned on the circumference of said elongated hollow member, (iv) a first longitudinally disposed vane extending outwardly from the outer surface of said elongated hollow member, and (v) a second longitudinally disposed vane extending outwardly from said outer surface of said elongated hollow member; wherein said first longitudinally disposed vane is attached through a first slot in said elongated hollow member and said second longitudinally disposed vane is attached through a second slot in said elongated hollow member.

14. The method of claim 13, wherein said elongated hollow member further comprises a plurality of two-way flow valves.

15. The method of claim 14, wherein said first longitudinally disposed vane and said second longitudinally disposed vane have a radial length that is about 5 to 90 percent of the average diameter of the elongated hollow member.

16. The method of claim 15, wherein said first longitudinally disposed vane and said second longitudinally disposed vane have a longitudinal length that is about 50 to 100 percent of the average longitudinal length of the elongated hollow member.

17. The method of claim 16, wherein said load transfer device is positioned at the zero degree location on the circumference of said elongated hollow member, said first longitudinally disposed vane is positioned between about 45 degrees and about 135 degrees from said zero degree location, and said second longitudinally disposed vane is positioned between about 225 degrees and about 315 degrees from said zero degree location.

18. The method of claim 16, wherein said elongated hollow member is substantially tubular in shape and has a substantially circular cross sectional area.

19. The method of claim 18, wherein said upper end of said elongated hollow member is closed and wherein said valves are located on the upper end of said elongated hollow member, said valves adapted for regulating fluid flow across said upper end of said elongated hollow member.

20. The method of claim 19, wherein said elongated hollow member further comprises at least one additional longitudinally disposed vane extending outwardly from the outer surface of said elongated hollow member positioned between about 135 degrees and about 225 degrees from said zero degree location.

21. The method of claim 20, wherein said elongated hollow member further comprises at least one additional longitudinally disposed vane extending outwardly from the outer surface of said elongated hollow member positioned between about 45 degrees on each side of said zero degree location on the outer surface of said tubular member.

22. The method of claim 21, wherein said load transfer device comprises a padeye.

23. The method of claim 13, wherein said first and second slots are diametrically opposed, and said first and second longitudinally disposed vanes comprise a single vane extending through said first and second slots in said elongated hollow member.

24. The method of claim 17, wherein said installation step includes:

a. positioning said pile anchor at an inclined angle with respect to the sea floor, the top of said pile anchor being inclined in a direction away from the direction of a lateral loading; and b. inserting said pile anchor at least partially into said sea floor, said pile anchor substantially maintaining said inclined angle.

25. A method of producing offshore hydrocarbon resources, comprising:

a. anchoring an offshore structure to the seabed through use of a pile anchor system, said pile anchor system including (i) an elongated hollow member having an upper end, an open lower end, a longitudinal axis and a transverse cross section, (ii) a two-way flow valve located on said elongated hollow member, (iii) a load transfer device for connecting an anchor line to said elongated hollow member, said load transfer device fixed to the outer surface of said elongated hollow member and positioned on the circumference of said elongated hollow member, (iv) a first longitudinally disposed vane extending outwardly from the outer surface of said elongated hollow member; and (v) a second longitudinally disposed vane extending outwardly from said outer surface of said elongated hollow member;

b. connecting said load transfer device to an offshore structure; and c. producing hydrocarbon resources, wherein said first longitudinally disposed vane and said second longitudinally disposed vane are attached to the elongated hollow member at an angle relative to a plane tangent to the elongated hollow member and are located in two separate planes that form an angle at the point of attachment; or wherein said first and second longitudinally disposed vanes are curved, semicircular, non-planar vanes; or wherein said first and second longitudinally disposed vanes are a single planar vane attached to the back-side of the elongated hollow member.

26. The method of claim 25, further comprising transporting said hydrocarbon resources to shore.

27. A method of producing offshore hydrocarbon resources, comprising:

a. anchoring an offshore structure to the seabed through use of a pile anchor system, said pile anchor system including (1) an elongated hollow member having an upper end, an open lower end, a longitudinal axis and a transverse cross section, (ii) a two-way flow valve located on said elongated hollow member, (iii) a load transfer device for connecting an anchor line to said elongated hollow member, said load transfer device fixed to the outer surface of said elongated hollow member and positioned on the circumference of said elongated hollow member, (iv) a first longitudinally disposed vane extending outwardly from the outer surface of said elongated hollow member, and (v) a second longitudinally disposed vane extending outwardly from the outer surface of said elongated hollow member;

b. connecting said load transfer device to an offshore structure; and c. producing hydrocarbon resources, wherein each of said first longitudinally disposed vane and said second longitudinally disposed vane comprises two vane elements, a first vane element attached perpendicular to a vane tangent to said elongated hollow member and a second vane element attached to each of the first vane elements at an angle.

28. The method of claim 27, further comprising transporting said hydrocarbon resources to shore.

29. A pile anchor, comprising:

a. an elongated hollow member having an upper end, an open lower end and a longitudinal axis;

b. a plurality of two-way flow valves located on said elongated hollow member;

c. a load transfer device for connecting an anchor line to said elongated hollow member, said load transfer device fixed to the outer surface of said elongated hollow member and positioned on the circumference of said elongated hollow member;

d. a first longitudinally disposed vane extending outwardly from the outer surface of said elongated hollow member; and e. a second longitudinally disposed vane extending outwardly from said outer surface of said elongated hollow member; wherein said first longitudinally disposed vane is attached through a first slot and said second longitudinally disposed vane is attached through a second slot in said elongated hollow member; and wherein said first longitudinally disposed vane and said second longitudinally disposed vane have a radial length that is about 5 to 90 percent of the average diameter of the elongated hollow member and a longitudinal length that is about 50 to 100 percent of the average longitudinal length of the elongated hollow member; and wherein said load transfer device is positioned at the zero degree location on the circumference of said elongated hollow member, said first longitudinally disposed vane is positioned between about 45 degrees and about 135 degrees from said zero degree location, and said second longitudinally disposed vane is positioned between about 225 degrees and about 315 degrees from said zero degree location.

* * * * *